US005127826A

United States Patent [19]

Acton et al.

[11] Patent Number: 5,127,826

[45] Date of Patent: Jul. 7, 1992

[54] RADIANT TUBE

[75] Inventors: Gordon K. Acton, Kingswinford; Edward G. Cousins, Walsall; Arthur Watson, Lichfield, all of Great Britain

[73] Assignee: Wellman Furnaces Ltd., Great Britain

[21] Appl. No.: 530,104

[22] Filed: May 17, 1990

[30] Foreign Application Priority Data

Jun. 14, 1989 [GB] United Kingdom ..... 8913619

[51] Int. Cl.[5] ..... F23D 14/46

[52] U.S. Cl. ..... 431/350; 126/91 A; 126/91 R

[58] Field of Search ..... 431/350, 11, 353; 126/91 R, 91 A

[56] References Cited

U.S. PATENT DOCUMENTS

| | | | |
|---|---|---|---|
| 3,177,865 | 4/1965 | Jones et al. | 126/109 |
| 4,474,120 | 10/1984 | Adrian et al. | 431/174 |
| 4,493,309 | 1/1985 | Wedge et al. | 126/91 A |

*Primary Examiner*—Larry Jones

*Attorney, Agent, or Firm*—Learman & McCulloch

[57] ABSTRACT

A single ended radiant tube for furnace heating has four concentric tubes (10, 12, 14, 16). Fuel gas is fed through tube (16) and combustion air through the space between tubes (12, 14). Flame and combustion products flow first in the same direction as the gas and air and then reverse at the end of tube (12) to flow in the opposite direction between that and tube (10). The combustion air is caused to flow in a helical pattern by the provision of helix (36) so as to provide an extended flow path for better heat transfer.

6 Claims, 2 Drawing Sheets

RADIANT TUBE

BACKGROUND OF THE INVENTION

The invention relates to single ended radiant tubes used for furnace heating. The conventional design for this purpose has at least three concentric tubular parts, the outermost or first of which contains the burning fuel and provides the radiant heating effect. The flow of combustion gases in this tube is opposite in direction to that of flow in the other tubes. The innermost of the tubes supplies the fuel to be burnt up to a burner head on the end of that tube and located between the two ends of the outermost tube. Combustion air is supplied through an intermediate tube surrounding the fuel tube and effectively inside the flow of combustion products contained in the outer tube. This is so that the air supplied may cool the burner parts behind the flame and so that the air is pre-heated.

The burner comprises a number of ports for the fuel flow, which especially in small diameter tubes necessarily open radially in order to get good fuel air mixing. This creates the risk of flame impingement on local spots on the surrounding tube, which can lead to premature burn-out. In fact, premature failure of these tubes is almost invariably caused by burn-out due to local overheating.

It is usual to provide a fourth tube lying within the air supply tube so as to confine the combustion air to a smaller cross-sectional area and achieve better heat transfer. This also gives a more rapid flow of the air past the burner so as to carry the flame and combustion products along the tube in an attempt to avoid the radial hot spots adjacent the burner as mentioned. This improvement is particularly difficult to achieve satisfactorily in smaller diameter radiant tubes.

In prior Patent GB 2 133 527 the fourth tube terminates short of the burner head so as to expose the final part of the second tube (fuel supply) to the combustion air, and the head itself has spiral vanes which are intended to induce a vortex flow system in the combustion air with the aim of confining the burner flame to the central part or axis, further to prevent flame impingement on the surrounding tube. This feature is of course only effective over the length of gas flow in the same direction as that of fuel and air up to the burner, and ceases to be effective in the reverse flow portion.

SUMMARY OF THE INVENTION

The object of the present invention is to provide further improvements.

According to the invention, a radiant tube comprises four substantially concentric tubes of which the outermost (first) provides the radiant heating effect, the next (second) adjacent and shorter tube contains the burning fuel, the space between this tube and the first providing a return flow path for combustion gases, the space between the said next adjacent tube and a (third) tube provides a flow path for combustion air, and the (fourth) innermost tube conducts fuel to a burner; the combustion air being caused to swirl in its flow towards and over the burner by providing a helical path for said flow in said space, and the helical path and the said third tube terminating short of the burner.

By these means, the recuperative preheating of combustion air is provided as usual, but the flow path of that air is substantially increased, enabling the exit temperature for the exhaust gases to be lowered and thus reducing the risk of burn-out of the second tube. This effect occurs not only over the area exposed to the helical flow, but also upstream over the same tube because of the conductive effects. Advantage may also be gained from the better scouring effect obtained from the more rapid flow which results from the extended flow path, thus further reducing the possibility of local hotspots due to flow abnormalities. Moreover, the spiralling flow along the inside of the second tube is believed to continue beyond the end of the third tube and the helix which causes that spiralling flow, so as to cause the combustion air to bathe and encircle the flame providing similar freedom from burn-out along the length of the second tube.

It will be appreciated by those skilled in the art that these radiant tubes are required in a great variety of lengths and diameters to suit different furnace needs. Each has a different set of parameters. In order to achieve the best possible results in the invention with any specific tube adjustment is done empirically on a prototype and may be set for a particular combination of required operating conditions which include effectively the diameter and length of the first tube and the required heat output. The two factors to be so adjusted are the swirl effect on the combustion air, which can be varied by varying the angle of the helix, and secondly the adjustment, of the gas discharge slot area, where the gas issues from the fourth (supply) tube into the combustion space.

The helix may be provided by a length of rod or wire wound about the said third tube and tack welded in position.

The third tube may terminate substantially short of the burner head, and the fourth (gas supply) tube may then be held centrally within the structure by means of radial pegs which can be arranged to offer minimal resistance to the swirling flow of air.

A particular problem with small diameter radiant tubes is the difficulty of providing adequate viewing space to sense the presence of a flame by ultra violet detector. It is conventional to provide a spark rod extending generally centrally of the arrangement, for example at the side of the gas flow tube, for ignition purposes, and according to a feature of the present invention the same spark rod is used as an ionization probe for flame sensing.

Another difficulty with small diameter radiant tubes is that of maintaining a flame at low flame rates as compared to the normal operating conditions. According to a further feature of the present invention, the said fourth tube houses a concentrically aligned fifth tube provided with a separate burner arrangement. The fifth tube is to be provided with fuel/air e.g. gas/air mixture for burning at the additional burner, whereas the annular space between that pilot tube and the fourth tube provides the flow space for main flame gas, and an annular plug closing that space is ported and slotted to provide jet orifices for main gas flow emission to burn with the combustion air provided between the second and third tubes. Said plug may be extended to act as an extension of the pilot (fifth) tube which forms a burner nozzle for the additional burner.

According to another feature of the invention, the said closure plug is radially flanged, and the flange causes substantially radial flow of the gas beyond what is possible from merely radial ports and creates an eddy turbulence to ensure good admixture with the swirling air.

DETAILED DESCRIPTION OF THE INVENTION

Figure 1:
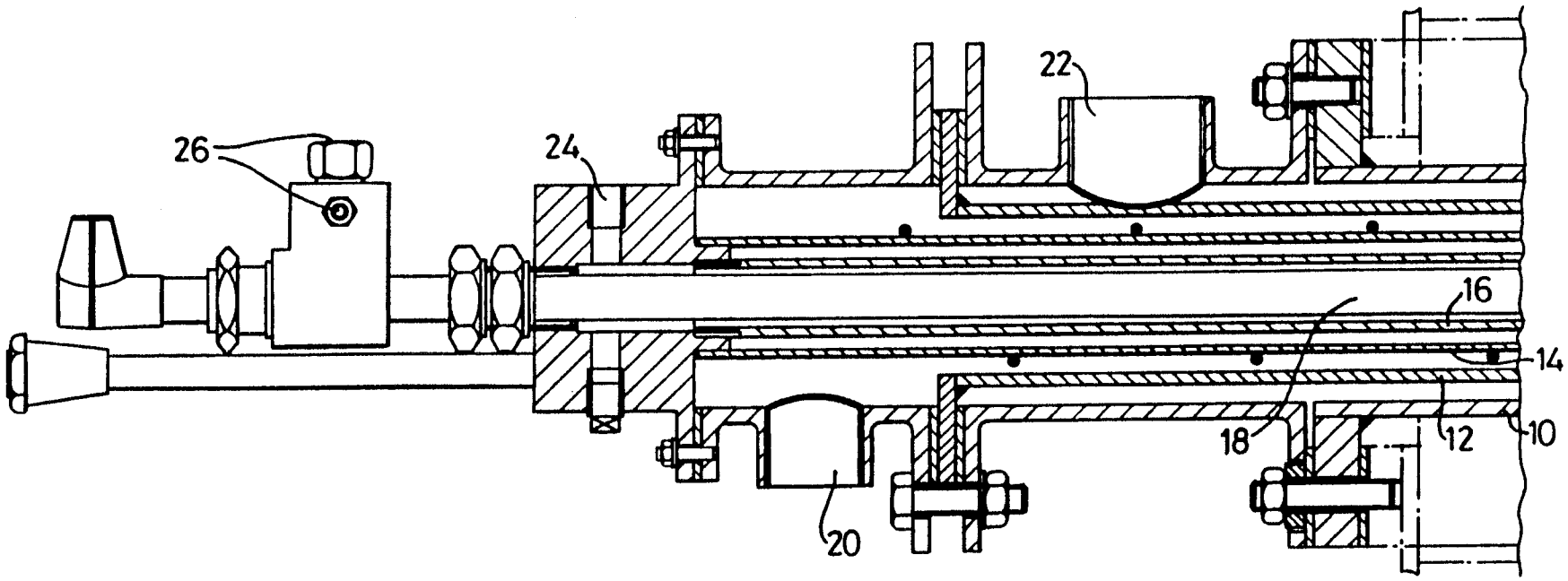
FIG. 1 is a sectional view of the invention showing the fuel and air inlet end.
Figure 2:
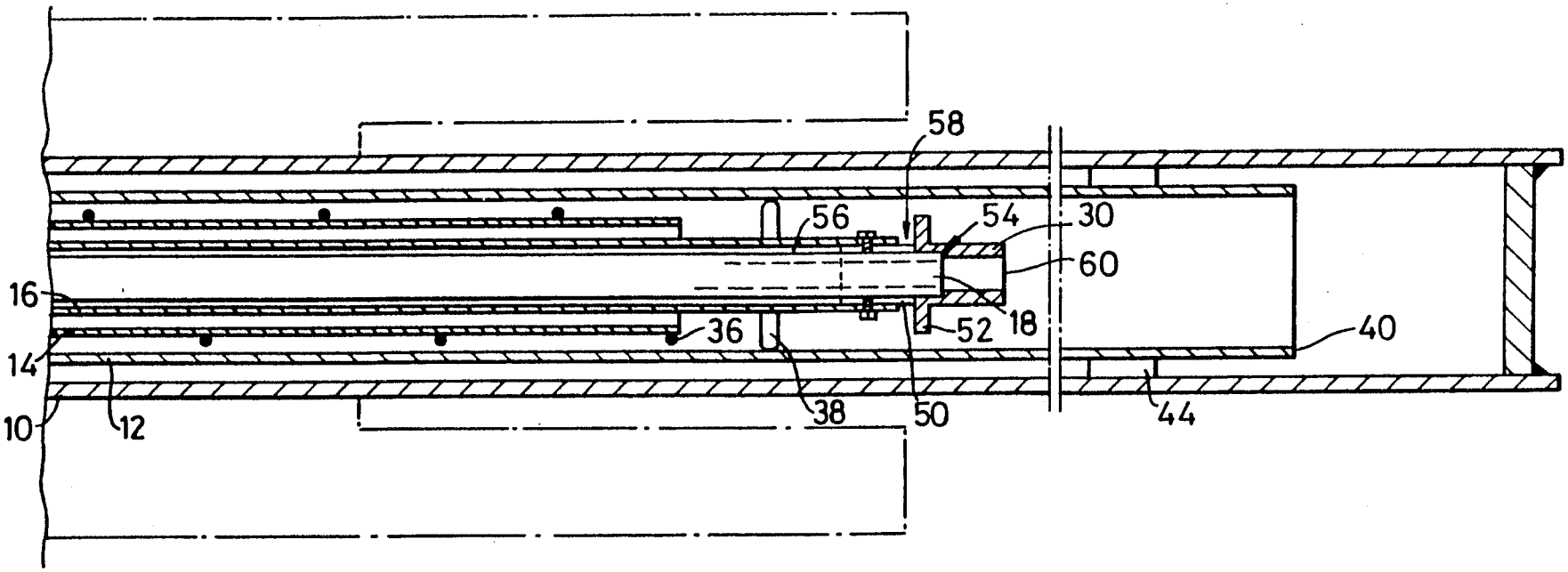
FIG. 2 is a sectional view showing the free end of the flame tube.

The invention is more particularly described with reference to the accompanying drawings wherein the said first to fifth tubes are indicated by the reference numerals 10, 12, 14, 16 and 18. The combustion air inlet 20 opens to the annular space between the tubes 12 and 14, whereas the exhaust outlet 22 opens from the space between the first and second tubes.

The main gas inlet 24 opens to the space between the fourth and fifth tubes, and gas and air inlets 26 open to the interior of the pilot tube 18. The extended reach spark/ionization probe is mounted centrally inside the pilot tube 18'.

Plug 30 is fixed in the end of tube 16 and is radially slotted at a number of positions 50. The plug is provided with a radial flange 52 extending beyond the diameter of the tube 16. Internal shoulder 54 abuts the end of the tube 18. Hence the main fuel gas flow is through the annular space 56 exiting through the radial ports 58 and the flange 52 causes eddying and turbulence so that the combustion air flow entrains the fuel gas and takes the flame and combustion products downstream. Low rate heating effect is provided by gas air mixture emerging from the free end of the plug 60.

The helical guide 36 causing the swirling air flow is shown as a circular cross section wire wound about the tube 14 and for example tack welded in place. Radial pegs 38 centre the flame tube 12. The helix also improves heat transfer (recuperative heating) of the combustion air.

In practice, the swirling air flow substantially bathes and surrounds the flame with air which is yet to be used for combustion over a substantial part of the length between the issuing gas and the free end 40 of the flame tube. Before the flame reaches the free end of the flame tube, the heat has been dissipated over a substantial length of the arrangement and thus localised overheating is avoided.

Abutments 44 are used to support the flame tube in the main tube 10.

We claim:

1. A radiant tube construction for furnace heating comprising first, second, third, and fourth substantially concentric tubes between each of which is an annular space, said first tube being outermost for providing a radiant heating effect, said second tube constituting a burner tube for burning fuel therein, the space between said first and second tubes providing a return flow path for combustion gases, said third tube terminating short of said second tube and the space between said second and third tubes forming a flow path for combustion air, said fourth tube constituting a fuel conduit for supplying fuel to said second tube; and means in the space between said second and third tubes for forming a helical flow path for the combustion air to cause said combustion air to flow in a helical path along said second tube to extract heat therefrom and preheat said combustion air.

2. A radiant tube as claimed in claim 1 wherein the helical path is provided by a length of rod or wire wound about the exterior of the third tube and tack-welded in place.

3. A radiant tube as claimed in claim 1 wherein a spark rod is located centrally of the fourth tube and adapted for use as an ionization probe for flame sensing.

4. A radiant tube as claimed in claim 1 wherein a fifth and innermost tube is provided in the fourth tube, having a separate burner arrangement at its inner end and connected to a separate gas/air supply at its outer end.

5. A radiant tube as claimed in claim 4 wherein the space between the fourth and fifth tubes provides the main combustion gas flow passage, an annular plug closes the inner end of said passage axially beyond the inner end of the third tube, said plug is radially slotted to provide burner nozzle jets, and said plug has a flange extending radially beyond the fourth tube toward the second tube to cause turbulence and eddying in the fuel/air mixture.

6. A radiant tube construction as claimed in claim 1 wherein said second tube extends beyond said fourth tube and extends the helical path of said combustion air beyond said third tube.

* * * * *